US007810474B2

(12) United States Patent
Kito et al.

(10) Patent No.: US 7,810,474 B2
(45) Date of Patent: Oct. 12, 2010

(54) VENTING DEVICE FOR FUEL TANK

(75) Inventors: Hiroaki Kito, Aichi-ken (JP); Hiroshi Nishi, Aichi-ken (JP); Shoji Horiba, Aichi-ken (JP)

(73) Assignee: Toyoda Gosei Co., Ltd., Aichi-pref. (JP)

( * ) Notice: Subject to any disclaimer, the term of this patent is extended or adjusted under 35 U.S.C. 154(b) by 0 days.

(21) Appl. No.: 12/453,745

(22) Filed: May 21, 2009

(65) Prior Publication Data

US 2009/0293849 A1 Dec. 3, 2009

(30) Foreign Application Priority Data

May 28, 2008 (JP) ..... 2008-138826

(51) Int. Cl.
*F02M 37/20* (2006.01)
*F02M 33/02* (2006.01)

(52) U.S. Cl. ..... 123/516; 123/519; 137/583; 137/587; 137/588; 137/589

(58) Field of Classification Search ..... 123/516, 123/518, 519, 520, 521; 137/583–590
See application file for complete search history.

(56) References Cited

U.S. PATENT DOCUMENTS 4,605,032 A * 8/1986 Hayashi et al. ..... 137/44
5,215,132 A * 6/1993 Kobayashi ..... 141/302
5,392,804 A * 2/1995 Kondo et al. ..... 137/202
5,443,561 A * 8/1995 Sakata et al. ..... 137/202
5,462,100 A * 10/1995 Covert et al. ..... 141/59
5,782,258 A * 7/1998 Herbon et al. ..... 137/43
5,813,434 A * 9/1998 Horiuchi et al. ..... 137/587
5,893,353 A * 4/1999 Mukai ..... 123/520
5,906,189 A * 5/1999 Mukai et al. ..... 123/519
6,675,779 B2 * 1/2004 King et al. ..... 123/519
7,152,586 B2 * 12/2006 Aoki et al. ..... 123/516
7,347,191 B2 * 3/2008 Atwood et al. ..... 123/516

FOREIGN PATENT DOCUMENTS

JP A-2006-44586 2/2006

* cited by examiner

*Primary Examiner*—Thomas N Moulis
(74) *Attorney, Agent, or Firm*—Posz Law Group, PLC

(57) ABSTRACT

The fuel tank venting device is furnished with a full fuel control valve and a rollover valve that are installed on a fuel tank, and a fuel tank valve unit having a pressure valve that is situated between a canister and the two valves. The pressure valve is furnished with a casing that has a valve chamber, a valve body housed within the valve chamber, and a spring. The valve body has a disk-shaped valve part and a side wall that projects with tubular contours from the outside perimeter of the valve part, and has a cup shape defining a spring chamber that is bounded by the valve part and the side wall. The valve part is perforated by an orifice of smaller planar dimensions than the valve aperture.

5 Claims, 6 Drawing Sheets

VENTING DEVICE FOR FUEL TANK

This application claims the benefit of and priority from Japanese Application No. 2008-138826 filed May 28, 2008, the content of which is incorporated herein by reference.

BACKGROUND OF THE INVENTION

1. Field of the Invention

The present invention relates to a venting device for use in an automotive fuel tank and adapted to regulate pressure in the fuel tank.

2. Description of the Related Art

A fuel tank venting device is disclosed for example in JP 2006-44586 A. Specifically, the automotive fuel tank system is furnished with a fuel cutoff valve installed in the upper part of the fuel tank, a canister connected to the fuel cutoff valve via an external passage, and a check valve disposed in the external passage. The fuel cutoff valve is employed as a full fuel control valve designed to close during fueling, or as a rollover valve designed to close when the vehicle tilts; and through rise and fall of a float in accordance with the fuel level in the tank will ensure that vapors are vented to the outside, as well as preventing fuel from spilling out from the fuel tank. The check valve is designed to inhibit fuel which has seeped from the tank into the fuel cutoff valve from flowing into the canister, as well as to open according to tank internal pressure in order to prevent tank internal pressure from rising above a prescribed value and to prevent fuel from being sprayed back out from the inlet pipe during fueling.

However, a problem with the check valve of the conventional fuel tank venting device is that if there is a sudden rise in tank internal pressure, the valve may not be able to respond adequately to prevent fuel from seeping into the canister or to prevent fuel from being sprayed back during fueling.

SUMMARY

An advantage of some aspects of the invention is to provide a fuel tank venting device affording in a simple design a pressure valve that is able to effectively prevent fuel spray-back even if tank internal pressure should rise suddenly during fueling.

According to an aspect of the invention is provided with a fuel tank venting device comprising a fuel cutoff valve unit adapted to open and close a passage leading to a canister according to a fuel level in a fuel tank; and a fuel tank valve unit connected to the fuel cutoff valve unit through a pipe and adapted to open and close the passage according to tank internal pressure. The fuel cutoff valve unit includes a first fuel cutoff valve adapted to close a first connecting passage through uplift of a first float mechanism when the fuel level in the fuel tank has exceeded a first level, and a second fuel cutoff valve adapted to close a second connecting passage through uplift of a second float mechanism when the fuel level in the fuel tank has exceeded a second level higher than the first level, and the fuel tank valve unit includes a first connector tube part that has a first flow passage connecting the first connecting passage with the canister, a second connector tube part that has a second flow passage connecting the second connecting passage with the first flow passage, and a pressure valve adapted to open and close the passage according to the tank internal pressure through the second flow passage. The pressure valve includes a casing that has a valve chamber situated facing the second flow passage, a valve body housed within the valve chamber to open and close a valve aperture that is formed in the casing and disposed facing the second flow passage, and a spring for urging the valve body towards a closed direction, wherein the valve body has a valve part, a side wall projecting with tubular contours from an outer circumference of the valve part, a spring chamber bounded by the valve part and the side wall and adapted to receive the spring, and an orifice perforated in the valve part with smaller planar dimensions than the valve aperture.

According to this first mode, during fueling, when the fuel level in the fuel tank exceeds a first level, tank internal pressure will rise due to closing of the first fuel cutoff valve. Through the second fuel cutoff valve, the elevated tank internal pressure will come to bear on the valve body of the pressure valve of the fuel tank valve unit, whereupon the valve body will open up the valve aperture in opposition to the spring force of the spring. The tank internal pressure will thereby escape to the canister through the pressure valve of the fuel tank valve unit, thus preventing spray-back from the inlet pipe. At times other than fueling, the pressure valve will prevent fuel from spilling out from the second fuel cutoff valve; and by opening when tank internal pressure rises will limit the rise in tank internal pressure. The valve part of the valve body is perforated by an orifice. In the event of a sudden rise in tank internal pressure, the orifice will allow slight escape of tank internal pressure prior to opening of the pressure valve, thus acting to limit a sudden rise in tank internal pressure and to prevent spray-back by the pressure valve during fueling; and at times other than fueling will provide enhanced action to prevent fuel from seeping into the canister in the event of a sudden rise in tank internal pressure. Such an orifice may be easily formed so as to pass through the valve part, with no need to modify the design for enhancing sealing of the valve body or to modify the shape of the components which define the valve chamber, or the like.

Moreover, because the pressure valve is defined by a cup-shaped valve body, it is able to close in a more stable attitude as compared with a ball valve arrangement. Additionally, because the spring is housed in a spring chamber, i.e. it is bounded by the valve body, it will not cause disturbance of the flow through the valve chamber. Accordingly, tank internal pressure will be able to escape rapidly when the pressure valve is open.

In a second mode of the present invention, the casing has a first valve chamber-defining part of tubular shape projecting from the outside wall of the first connector tube part, and a second valve chamber-defining part formed in the end part of the second connector tube part and unified with the first valve chamber-defining part to define the valve chamber; and the second valve chamber-defining part has a guide wall projecting towards the valve chamber and adapted to guide the side wall of the valve body, wherein the guide wall defines in relation to the inside wall of the first valve chamber-defining part a valve chamber internal passage situated therebetween. This guide wall affords sliding of the valve body in a stable attitude; and because the guide wall defines between itself and the inside wall of the first valve chamber-defining part a valve chamber internal passage which is situated therebetween, flow resistance of the valve body when open can be reduced, allowing tank internal pressure to escape rapidly.

In a third mode of the present invention, the guide wall is notched in a portion thereof to constitute a notched passage of progressively larger passage area going from the valve chamber towards the first flow passage. With this design, the guide wall is able to guide the valve body, while the provision of the notched passage, which boosts flow into the valve chamber internal passage, serves to further reduce flow resistance.

BRIEF DESCRIPTION OF THE DRAWINGS

DESCRIPTION OF THE PREFERRED EMBODIMENTS (1) General Configuration of Fuel Tank Venting Device FS FIG. 1 shows a fuel tank venting device equipped with a fuel tank valve unit in accordance with an embodiment of the present invention. The fuel tank venting device FS is furnished with a full fuel control valve FFV (first cutoff valve) and a rollover valve FCV (second cutoff valve)of so-called 'outside-tank' design mounted on the upper wall inside a flattened fuel tank FT; a fuel tank valve unit 10 positioned to the outside of the fuel tank FT; a canister CN; and connector pipes connecting these. The full fuel control valve FFV is a valve designed so that a first float mechanism FU1 will uplift and close a first connecting passage CP1 when the fuel level inside the fuel tank FT has reached a first level FL1 during fueling. The rollover valve FCV is a valve that is situated so as to ensure venting to the outside even if the vehicle should tilt, and that is designed so that a second float mechanism FU2 will uplift and close a second connecting passage CP2 when the fuel level has reached a second level FL2. These valves serve to ensure venting of the fuel tank FT to the outside, as well as to prevent fuel from spilling out. The fuel tank valve unit 10 is furnished with three connector parts, namely, one connecting to the full fuel control valve FFV through a first pipe P1, one connecting to the rollover valve FCV through a second pipe P2, and one connecting to the canister CN through a third pipe P3. The unit functions to prevent spray-back of fuel from the inlet pipe IP during fueling.

(2) Configuration and Action of Fuel Tank Valve Unit 10

Figure 2:
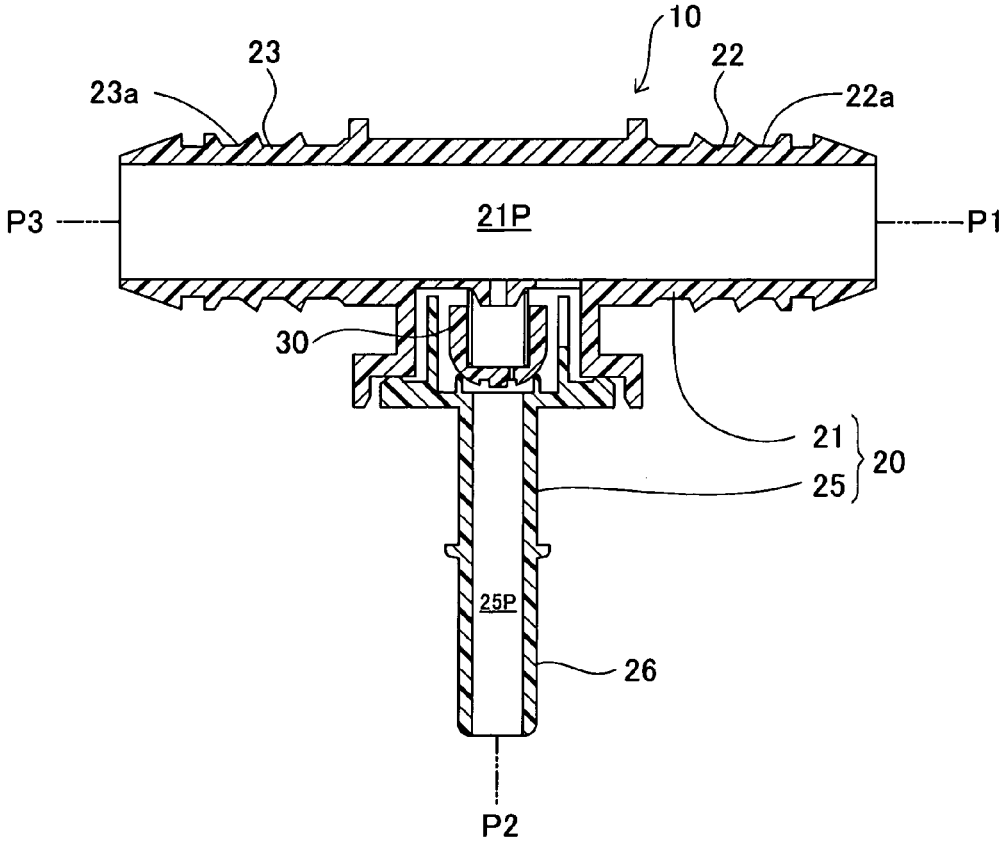
FIG. 2 is a sectional view depicting the fuel tank valve unit.

FIG. 2 is a sectional view depicting the fuel tank valve unit 10. The fuel tank valve unit 10 is furnished with a T-shaped casing 20 having three connector parts, and a pressure valve 30 that is housed inside the casing 20.

(2)-1 Configuration of Casing 20

The casing 20 has a T-shape, and is furnished with a first connector tube part 21 and a second connector tube part 25 that connects with the center part of the first connector tube part 21. The first connector tube part 21 defines a first flow passage 21P that is situated on a straight line, and is furnished at its two ends with a first connector part 22 adapted to connect with the first pipe P1 and with a second connector part 23 adapted to connect with the third pipe P3. Barbs 22*a*, 23*a* are respectively formed on the outside peripheral parts of the first connector part 22 and the second connector part 23. The first connector part 22 is connected to the first pipe P1 by being force-fit into the first pipe P1 which connects to the full fuel control valve FFV, and is retained therein by the barbs 22*a*; while the second connector part 23 is connected to the third pipe P3 by being force-fit into the third pipe P3 which connects to the canister CN, and is retained therein by the barbs 23*a*. The second connector tube part 25 defines a second flow passage 25P that connects to the first flow passage 21P, and is provided at its end with a third connector part 26 adapted for connection to the second pipe P2. The third connector part 26 is connected to the second pipe P2 by being force-fit into the second pipe P2 which connects with the rollover valve FCV.

(2)-2 Configuration of the Pressure Valve 30

Figure 3:
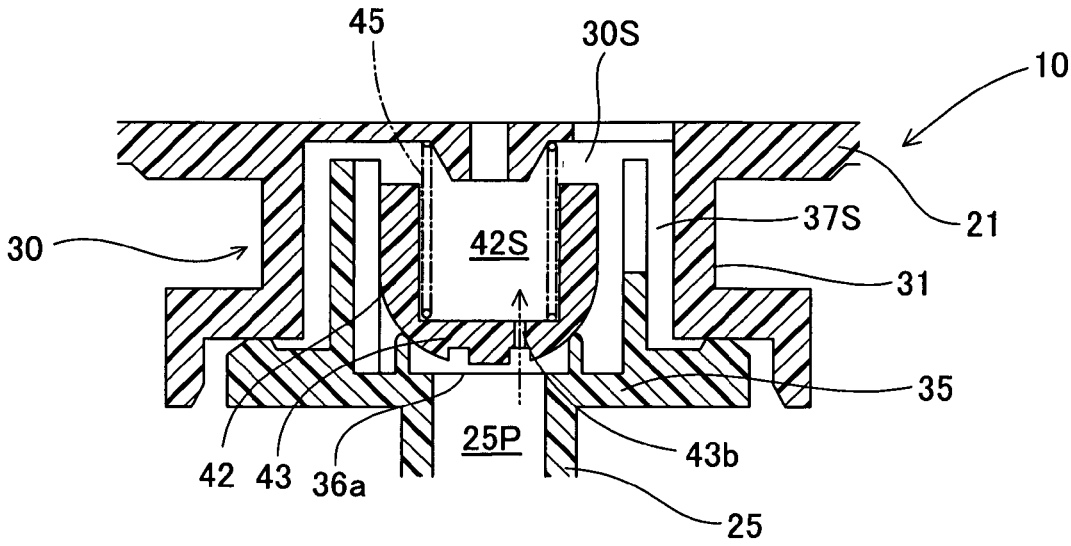
FIG. 3 is a sectional view of the area of the pressure valve in FIG. 2 depicted in enlarged view.

FIG. 3 is a sectional view of the area of the pressure valve in FIG. 2, depicted in enlarged view. The pressure valve 30 is situated at the confluence of the center part of the first connector tube part 21 and the end of the second connector tube part 25, and is provided as a check valve for preventing spray-back of fuel during fueling. Specifically, the pressure valve 30 is constituted by forming a first valve chamber-defining part 31 the outside peripheral part of the first connector tube part 21, and forming a second valve chamber-defining part 35 on the end of the second connector tube part 25 to define a valve chamber 30S; and housing a valve body 42 and a spring 45 inside this valve chamber 30S.

Figure 4:
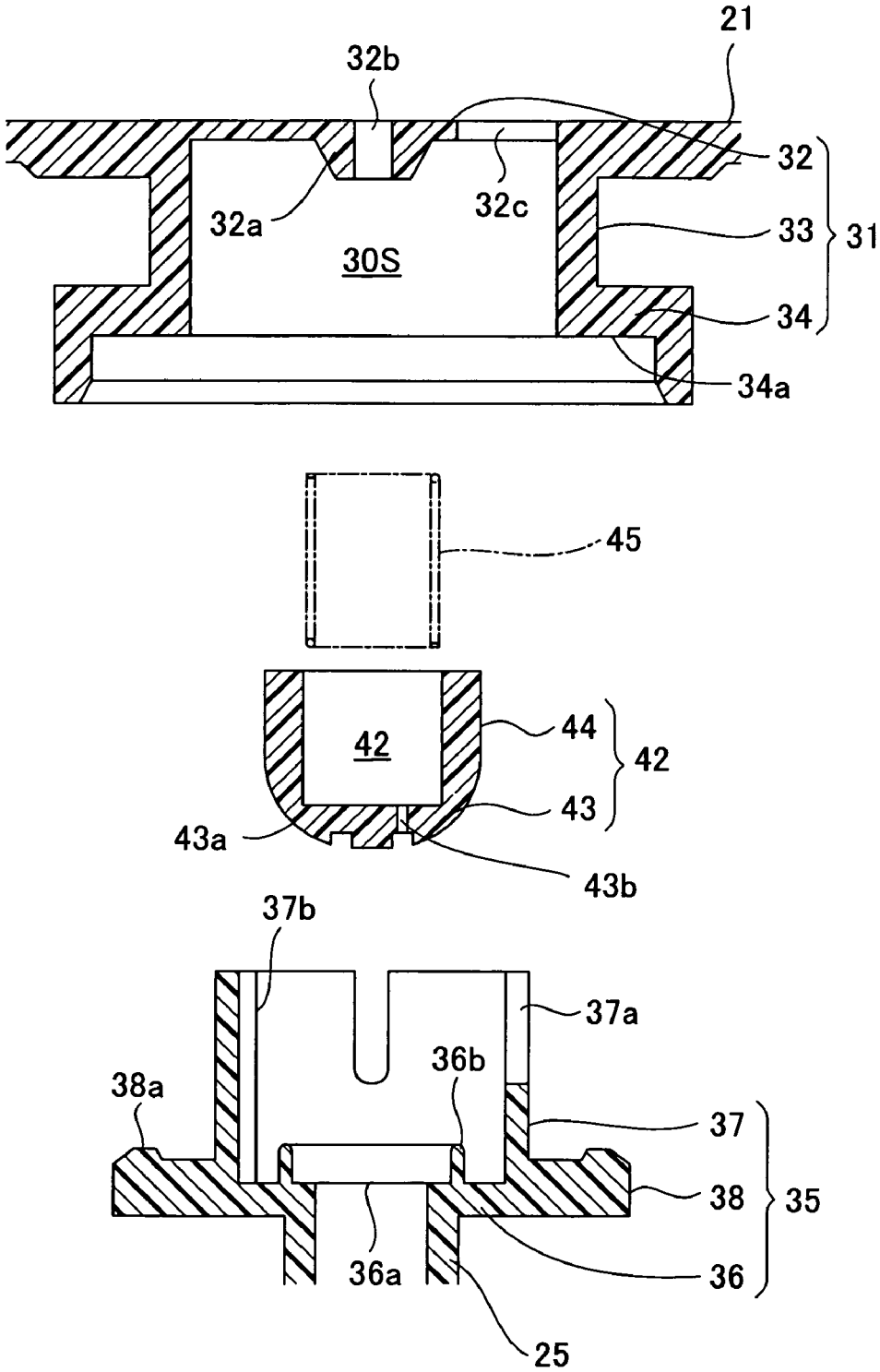
FIG. 4 is an exploded sectional view of the pressure valve.
Figure 5:
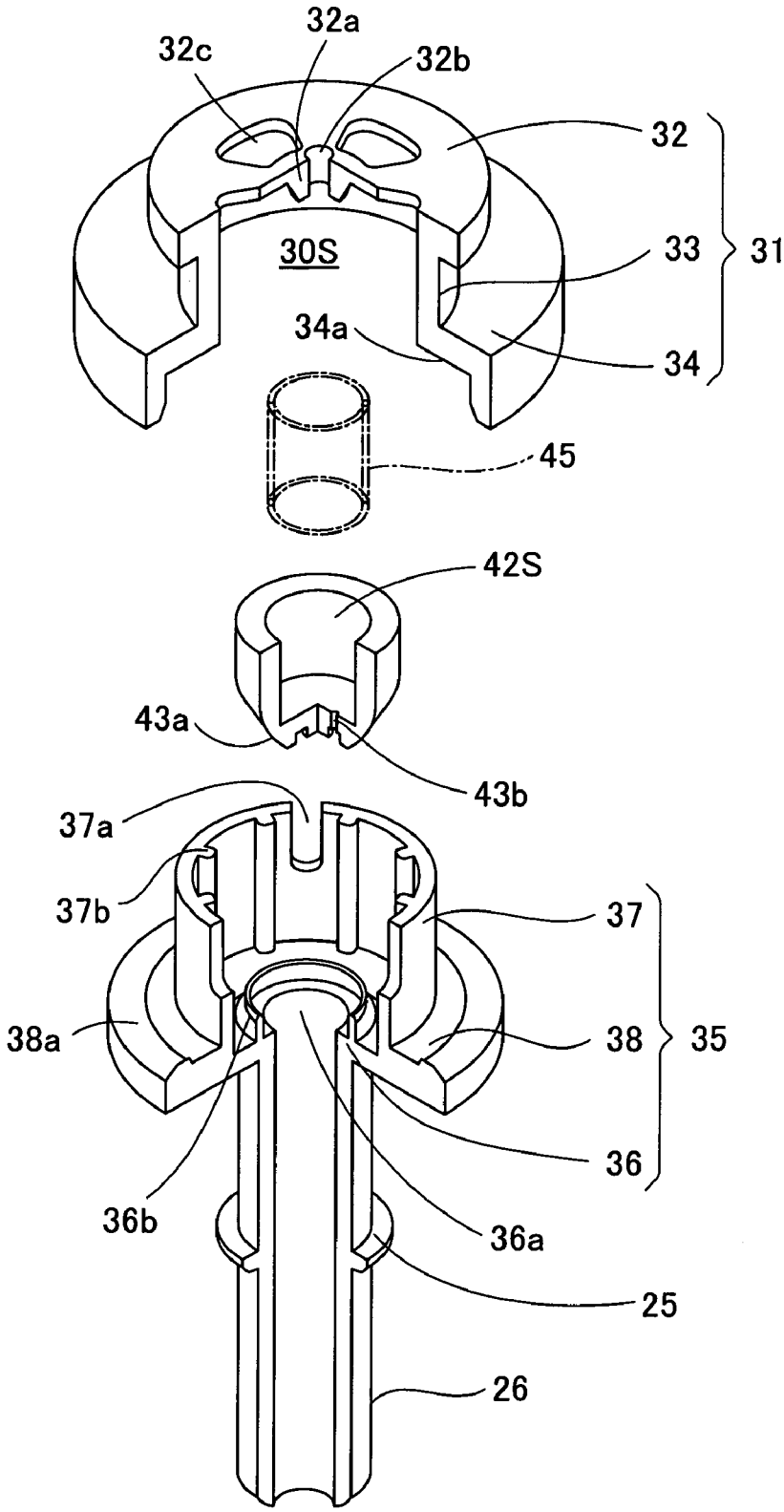
FIG. 5 is a partly fragmentary, exploded perspective view of the pressure valve.

FIG. 4 is an exploded sectional view of the pressure valve 30; and FIG. 5 is a partly fragmentary, exploded perspective view of the pressure valve 30. The first valve chamber-defining part 31, which lies towards the first connector tube part 21, is furnished with a passage wall 32 that extends along the pipe wall of the first connector tube part 21, a tube part 33 of round tube contours projecting from the passage wall 32, and a flange 34 that is formed at the end of the tube part 33. A support projection 32*a* is formed in the center part of the passage wall 32. A first vent hole 32*b* passes through the support projection 32*a*. Four second vent holes 33*c* (FIG. 5) of arcuate shape of prescribed width are formed surrounding the support projection 32*a*. The flange 34 spreads out from the end of the tube part 33 and is provided with a welding face 34*a* adapted to be welded to the second valve chamber-defining part 35.

The second valve chamber-defining part 35, which lies towards the second connector tube part 25, is furnished with a seal wall 36 that extends out at the end of the second flow passage 25P, a guide wall 37 of tubular contours extending from the outside peripheral part of the seal wall 36, and a flange 38 that flares out from the outside peripheral part of the seal wall 36. A valve aperture 36*a* that connects the valve chamber 30S to the second flow passage 25P is formed in the seal wall 36, and a seal projection 36*b* with annular contours projects up so as to encircle the valve aperture 36*a*. The guide wall 37 defines between itself and the inside wall of the tube part 33 a valve chamber internal passage 37S (FIG. 3) that constitutes a space with tubular contours. A notched passage 37*a* of notched slit shape is formed in the guide wall 37 from its distal edge, and guide ribs 37*b* adapted to guide the valve body 42 are formed on its inside wall. An annular welding projection 38*a* is formed on the flange 38. The annular welding projection 38*a* is adapted to be welded to the welding face 34*a* in order to define the valve chamber 30S which is bounded by the passage wall 32 of the first connector tube part 21, the tube part 33, and the seal wall 36 of the second connector tube part 25.

The valve body 42 is furnished with a valve part 43 of circular disk shape, and a side wall 44 that projects with tubular contours from the outside perimeter of the valve part 43; and has a cup shape whose internal space defines a spring chamber 42S. A seal part 43*a* having a convex curving face is formed at the end of the valve part 43. The convex curving face may be constituted as a curving face for which a desired curvature radius has been established, or a curving face constituting part of a hypothetical spherical face (so-called SR shape). The seal part 43*a* seats in the seal projection 36*b* to provide closure to the valve aperture 36*a*. An orifice 43*b* is formed in the valve part 43. The orifice 43*b* is a small hole provided for the purpose of allowing tank internal pressure to escape slightly so as to limit sudden rises in tank internal pressure, as will be discussed later. The spring 45 is housed within the spring chamber 42S, and is supported at one end by the support projection 32*a* of the passage wall 32, and at the other end by the base face of the valve part 43 of the valve body 42, thereby urging the valve body 42 towards the open direction.

According to the design of the pressure valve 30, if the force brought to bear on the valve body 42 in the open direction (upward in the drawing) due to tank internal pressure through the second pipe P2 and the second flow passage 25P overcomes the urging force of the spring 45 and the weight of the valve body 42, the valve body 42 will experience displacement towards the open direction causing the valve aperture 36*a* to open, whereby fuel vapors in the fuel tank will flow into the canister CN through the second pipe P2, the second flow passage 25P, the valve chamber 30S, and the first flow passage 21P.

(3) Fuel Tank Valve Unit 10 Assembly Operation

To attach the pressure valve 30 to the casing 20, after the valve body 42 and the spring 45 have been accommodated in the valve chamber 30S, the annular welding projection 38*a* of the flange 38 will be aligned resting on the welding face 34*a* of the flange 34, and a laser beam will then be directed towards the annular welding projection 38*a*. The annular welding projection 38*a* of the flange 38 will thereby be welded to the welding face 34*a* of the flange 34, unifying these components.

(4) Operation of Fuel Tank Venting Device FS

Figure 1:
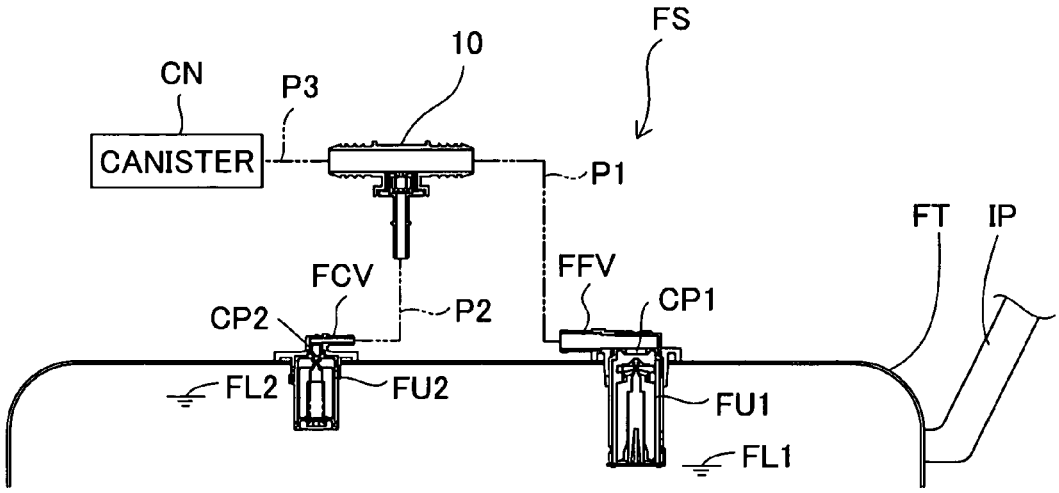
FIG. 1 shows a fuel tank venting device equipped with a fuel tank valve unit in accordance with an embodiment of the present invention.
Figure 6:
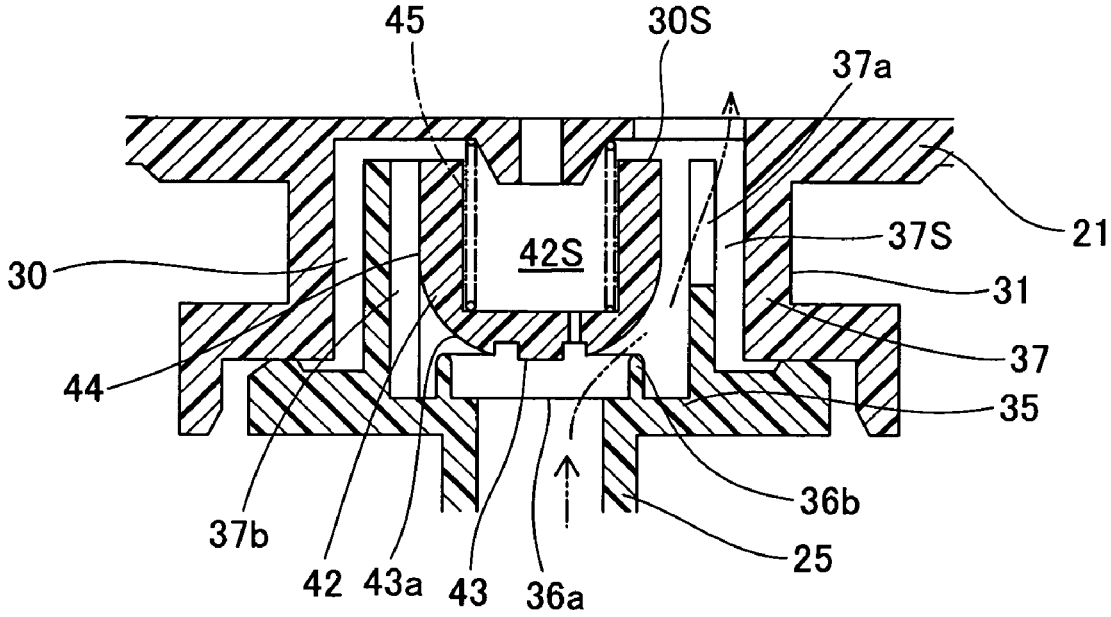
FIG. 6 shows operation of the pressure valve.

In FIG. 1, as the fuel tank FT is fueled by a fuel gun through the inlet pipe IP so that the fuel level inside the fuel tank FT reaches a first level FL1 (full tank level) and the full fuel control valve FFV closes, tank internal pressure will rise, activating the auto-stop function of the fuel gun. At this time the rollover valve FCV will be maintained in the open position, since the second level FL2 (which represents its valve closure level) has not been reached. The elevated tank internal pressure will be brought to bear on the valve body 42 of the pressure valve 30 through the rollover valve FCV, the second pipe P2, the second flow passage 25P of the fuel tank valve unit 10 depicted in FIG. 3, and the valve aperture 36*a*. The elevated tank internal pressure will then drop slightly by escaping through the orifice 43*b* of the valve body 42. Then, as depicted in FIG. 6, when the force bearing on the valve body 42 overcomes the urging force of the spring 45, the valve body 42 will separate from the seal projection 36*b* and the valve aperture 36*a* will open. Thus, tank internal pressure will escape into the canister CN through the pressure valve 30 of the fuel tank valve unit 10. That is, during fueling, a sudden rise in tank internal pressure arising when the full fuel control valve FFV has closed can be limited through escape of pressure to the canister CN through the pressure valve 30, thus preventing spray-back from the inlet pipe IP. At times other than fueling, the pressure valve will prevent fuel from spilling from the second fuel cutoff valve, and rise in tank internal pressure can be limited due to the valve opening when tank internal pressure has risen.

(5) Working Effects of the Embodiment

The embodiment described above affords the following working effects.

(5)-1 During fueling, if the fuel level in the fuel tank FT exceeds the full tank level, tank internal pressure will rise due to closing of the full fuel control valve FFV. Through the open rollover valve FCV, the elevated tank internal pressure will be exerted on the valve body 42 of the pressure valve 30 of the fuel tank valve unit 10, and the valve body 42 will separate from the seal projection 36*b* so that the valve aperture 36*a* opens. Thus, tank internal pressure will escape into the canister CN through the pressure valve 30 of the fuel tank valve unit 10, preventing spray-back from the inlet pipe IP. If there is a rise in tank internal pressure at times other than fueling, the tank internal pressure will escape, preventing fuel from seeping into the canister CN.

(5)-2 As depicted in FIG. 3, in the event of a sudden rise in tank internal pressure, the orifice 43*b* that has been formed passing through the valve part 43 of the valve body 42 will permit slight escape of tank internal pressure prior to opening of the pressure valve 30, thus acting to limit the sudden rise in tank internal pressure and to prevent spray-back by the pressure valve 30 during fueling; and at times other than fueling will provide enhanced action to prevent fuel from seeping into the canister CN in the event of a sudden rise in tank internal pressure. This orifice 43*b* may be easily formed so as to pass through the valve part 43, with no need to modify the design for enhancing sealing of the valve body 42*c* or to modify the shape of the components which define the valve chamber 30S etc.

(5)-3 Because the pressure valve 30 is defined by a valve body 42 of cup shape, it is able to close in a more stable attitude as compared with a ball valve arrangement. Additionally, because the spring 45 is housed in the spring chamber 42S, i.e. it is bounded by the valve body 42, it will not cause disturbance of flow through the valve chamber 30S. Accordingly, tank internal pressure will be able to escape rapidly when the pressure valve 30 is open.

(5)-4 By means of its guide ribs 37*b*, the guide wall 37 of the second valve chamber-defining part 35 guides the side wall 44 of the valve body 42 thereby affording sliding of the valve body 42 in a stabilized attitude; and moreover, because it defines the valve chamber internal passage 37S which is situated between itself and the inside wall of the first valve chamber-defining part 31, flow resistance of the valve body 42 when open can be reduced, allowing tank internal pressure to escape rapidly. Additionally, the notched passage 37*a* that has been formed in the guide wall 37 further reduces flow resistance into the valve chamber internal passage 37S.

(5)-5 In FIG. 6, because the seal part 43*a* of the valve part 43 is a convex curving face such as an SR shape and the seal projection 36*b* is a projection of tubular contours, even if the valve body 42 becomes seated in an inclined state in the seal projection 36*b*, a high level of sealing will be assured and the pressure receiving area of the valve body will be large enough to afford consistent valve-opening pressure.

The present invention is not limited to the embodiment set forth hereinabove, and may be embodied in various modes without departing from the spirit thereof, as shown for example by the following modified embodiments.

In the preceding embodiment, the guide ribs 37*b* that guide the valve body 42 have been provided on the guide wall 37, but no particular limitation is imposed thereby, and the ribs could instead be formed on the side wall, with the proviso that the design does not increase displacement of the valve body or flow resistance.

In the preceding embodiment, the orifice was formed at a single location, but a plurality of orifices could be formed in distributed fashion according to flow characteristics. While the seal portion 43*a* described above has a curving face, no particular limitation is imposed thereby, and a chamfered sloping face would be acceptable as well.

Figure 7:
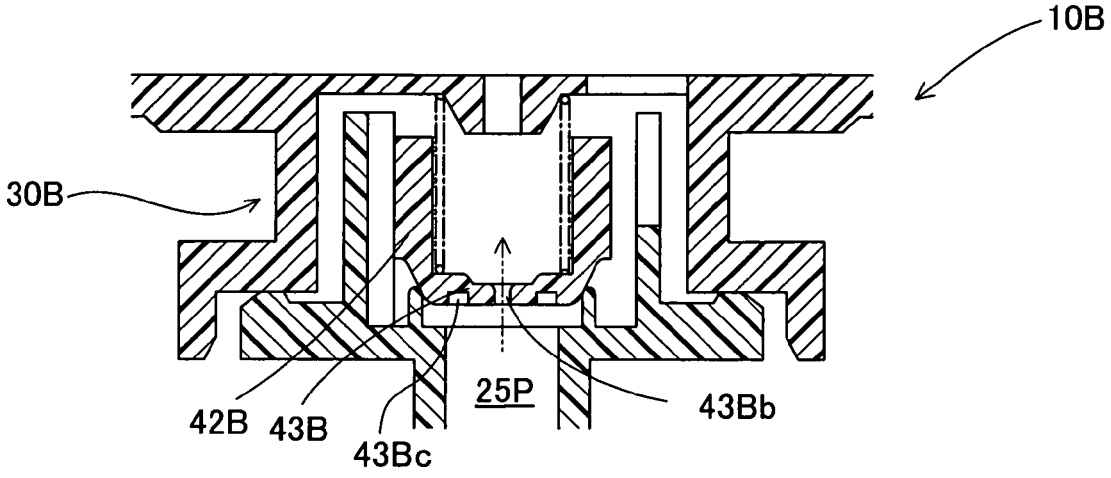
FIG. 7 is a sectional view depicting a pressure valve of a fuel tank valve unit in accordance with another embodiment.

FIG. 7 is a sectional view depicting a pressure valve 30B of a fuel tank valve unit 10B in accordance with another embodiment. This embodiment features a different shape for the valve body 42B of the pressure valve 30B. Specifically, the valve part 43B of the valve body 42B is disk shaped with an orifice 43Bb formed at its center. By forming the orifice 43Bb at the center of the valve body 42B, uniform pressure can be brought to bear on the pressure-receiving face of the valve part 43B, and play of the valve body 42B can be reduced. Additionally, an annular recess 43Bd is formed on the second flow passage 25P side of the valve part 43B, and is situated concentrically with and spaced apart by a prescribed distance from the orifice 43Bb. The annular recess 43Bd reduces the size of the thick section of the valve part 43B and affords enhanced accuracy of hole formation of the orifice 43Bb.

The foregoing detailed description of the invention has been provided for the purpose of explaining the principles of the invention and its practical application, thereby enabling others skilled in the art to understand the invention for various embodiments and with various modifications as are suited to the particular use contemplated. The foregoing detailed description is not intended to be exhaustive or to limit the invention to the precise embodiments disclosed. Modifications and equivalents will be apparent to practitioners skilled in this art and are encompassed within the spirit and scope of the appended claims.

What is claimed is:

1. A fuel tank venting device comprising a fuel cutoff valve unit adapted to open and close a passage leading to a canister according to a fuel level in a fuel tank; and a fuel tank valve unit connected to the fuel cutoff valve unit through a pipe and adapted to open and close the passage according to tank internal pressure, wherein the fuel cutoff valve unit includes (i) a first fuel cutoff valve adapted to close a first connecting passage through uplift of a first float mechanism when the fuel level in the fuel tank has exceeded a first level, and (ii) a second fuel cutoff valve adapted to close a second connecting passage through uplift of a second float mechanism when the fuel level in the fuel tank has exceeded a second level higher than the first level, and the fuel tank valve unit includes (i) a first connector tube part that has a first flow passage connecting the first connecting passage with the canister, (ii) a second connector tube part that has a second flow passage connecting the second connecting passage with the first flow passage, and (iii) a pressure valve adapted to open and close the passage according to the tank internal pressure through the second flow passage, wherein the pressure valve includes (i) a casing that has a valve chamber situated facing the second flow passage, (ii) a valve body housed within the valve chamber to open and close a valve aperture that is formed in the casing and disposed facing the second flow passage, and (iii) a spring for urging the valve body towards a closed direction, wherein the valve body has (i) a valve part, (ii) a side wall projecting with tubular contours from an outer circumference of the valve part, (iii) a spring chamber bounded by the valve part and the side wall and adapted to receive the spring, and (iv) an orifice perforated in the valve part with smaller planar dimensions than the valve aperture.

2. The fuel tank venting device in accordance with claim 1, wherein the casing has (i) a first valve chamber-defining part of tubular shape projecting from an outside wall of the first connector tube part, and (ii) a second valve chamber-defining part formed in an end of the second connector tube part and unified with the first valve chamber-defining part to define the valve chamber, wherein the second valve chamber-defining part has a guide wall projecting towards the valve chamber to guide the side wall of the valve body, the guide wall being configured to define in relation to an inside wall of the first valve chamber-defining part a valve chamber internal passage situated therebetween.

3. The fuel tank venting device in accordance with claim 2, wherein the guide wall has a notched passage that is notched in a portion of the guide wall, the notched passage being configured to increase a passage area, connecting between the valve chamber and the first flow passage.

4. The fuel tank venting device in accordance with claim 3, wherein the valve part is of circular disk shape, and the orifice is situated at a center of the valve part.

5. The fuel tank venting device in accordance with claim 1, wherein the valve part is of circular disk shape, and the orifice is situated at a center of the valve part.

* * * * *